US005544637A

United States Patent [19]

Tapia P.

[11] Patent Number: 5,544,637

[45] Date of Patent: Aug. 13, 1996

[54] SIMPLIFIED PUMPS FOR FUEL INJECTION

[76] Inventor: Héctor L. Tapia P., M. Arredondo No. 2539, Los Cipreses Lima 1, Peru

[21] Appl. No.: 374,182

[22] Filed: Jan. 18, 1995

[51] Int. Cl.[6] ..... F02M 37/00

[52] U.S. Cl. ..... 123/495; 417/469

[58] Field of Search ..... 417/468, 469, 417/494; 123/495–6, 446–7, 500–2, 507–9

[56] References Cited

U.S. PATENT DOCUMENTS

| | | | |
|---|---|---|---|
| 1,946,473 | 2/1934 | Babendreer et al. | 417/471 |
| 2,074,486 | 3/1937 | Peters | 417/468 |
| 2,183,510 | 12/1939 | Thomas | 417/471 |
| 4,463,725 | 8/1984 | Laufer et al. | 123/446 |
| 4,478,188 | 10/1984 | Eheim | 123/446 |

*Primary Examiner*—Thomas N. Moulis

[57] ABSTRACT

A fuel injection pump for internal combustion engines, where the driving source is the movement of an axle (11) held at the rod head whenever this is activated by the engine crankshaft (10), adjusting such movement by the use of auxiliary pieces (14, 17, 18), in order to get the alternative lineal movement required by the pump which is composed of a piston formed by four cylindric parts (25, 26, 27, 28), first and third part have an even diameter, second and fourth parts have a shorter diameter, the third part has a peripheric channel along it entire length (29), fourth part has an internal channel (30) with holes towards the periphery. The piston displaces within two consecutive sliding cylinders, the first cylinder (31) forms with the piston the compression chamber and at the time of sliding modifies the time when the injection is done. Second cylinder (32) fits into the fourth part of the piston and at the time of sliding modifies the amount of fuel passing from the compression chamber to the injector.

8 Claims, 6 Drawing Sheets

SIMPLIFIED PUMPS FOR FUEL INJECTION

This invention is to be applied to Internal Combustion Engines, and it modifies the fuel injection system, using, for each driving cylinder of the engine, individual inject ion pumps which driving source consists of a motion that allows a centered prolongation with respect to the symmetry axis of the head of the corresponding rod transforming that motion by means of self oscillating and/or sliding auxiliary pieces arranged in such a way that besides getting the alternative lineal motion required by the pump, they also supply the injection at the exact time it is required by the respective driving cylinder of the engine.

The injection pump essentially consists of a long, cylindric piston, composed of four parts; the first and third parts have an even diameter, the second and the fourth have a diameter that is shorter than the first and third parts, said third part has a peripheric channel along its entire length, which is parallel to its axis, the fourth part has an internal channel also parallel to the axis, which is making contact with the periphery by means of two holes, one of these holes is located at the brink of the fourth part at the limit of the third part. Such piston at the same time displaces itself within two consecutive cylinders which are sliding independently from each other, the first cylinder fits between the first and fourth part of the piston, forming with it the compression chamber having also two radially oriented holes which may get a diametral matching. One of these holes should match the above mentioned peripheric channel of the piston's third part, having also communication with the fuel discharging channel, towards the injector, while the other hole corresponds to incoming fuel.

The piston effective stroke takes place when the third part, at time of displacing pushes the fourth part covering the intake hole, then the fluid encased into the fourth part and first cylinder is allowed to escape either to the injector through the peripheric channel, or to the internal channel of the piston's fourth part, but when the second cylinder which slides over the piston's fourth part, covers the farthest hole of the internal channel of such part, only the discharge toward the injector is free. In view of the above the sliding of the second cylinder may increase or reduce the amount of fluid outcoming from the hole that feeds the injector. Since the piston displaces between two stopping points, the sliding of first cylinder forces admission and discharge holes to move forward or backward according to the piston displacing limits. This could be applied to advance or delay the fuel injection Diesel Engines.

The advantage of this injection system over the current ones is based on its simple mechanism; the piston does not require helicoidal threading.

Figures 6, 7, 8:
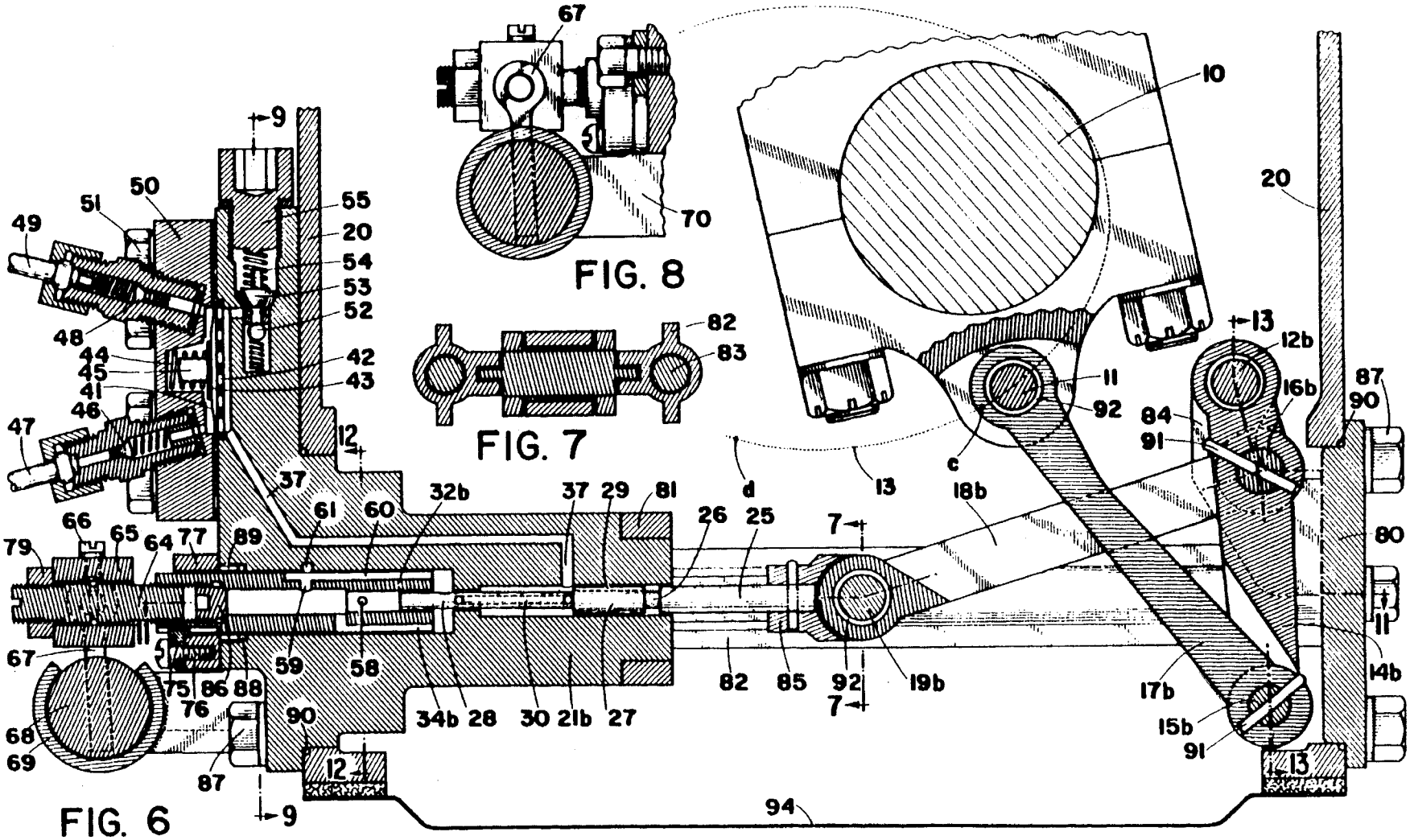

From FIG. 6 up to 15, they correspond to a pump type similar to the previous one, adequate for gasoline engines, but in this case with indirect control using two circuits.

FIG. 6 shows the above mentioned pump type with a section view made by a symmetry plane through the axis, it shows the driving system in the position corresponding to one of the idle points in the alternative stroke.

FIG. 7 shows a sectional view along the 7— 7 line of FIG. 6 which shows an axis sliding guides.

Figure 10:
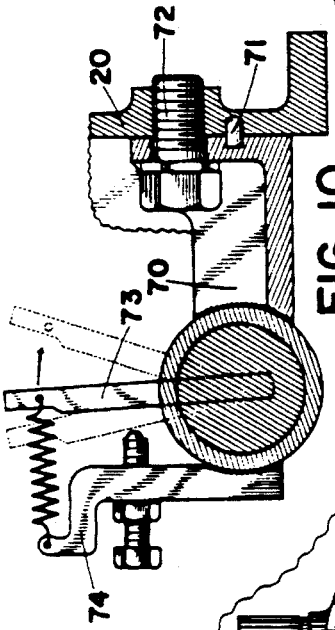
Figure 9:
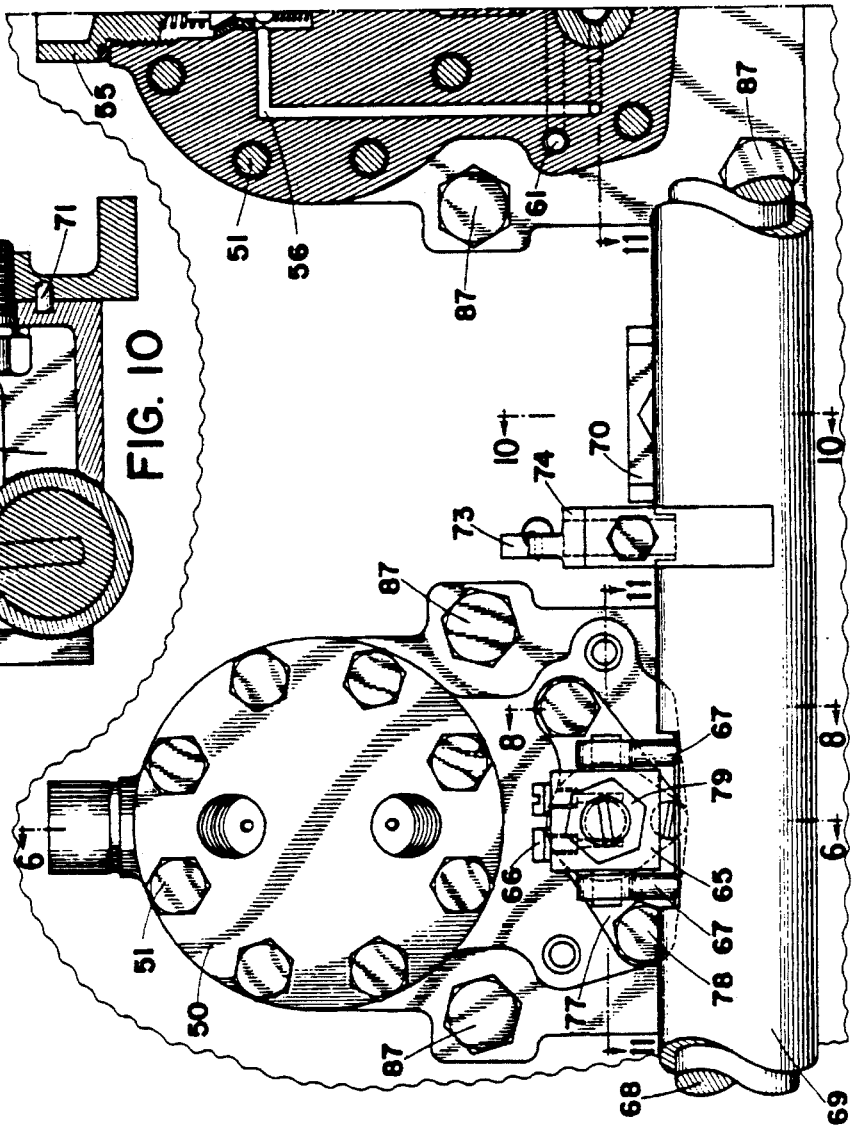

FIG. 8 and 10 are sectional views along the 8— 8 and 10— 10 lines respectively to FIG. 9 and show features of the control system.

FIG. 9 shows two of these pumps in parallel, corresponding in consequence to adjacent driving cylinders of an engine, one of the views taken from outside without having installed the retention valves of the fuel circuit, and the other is cut by a plane as shown in FIG. 6.

Figure 11:
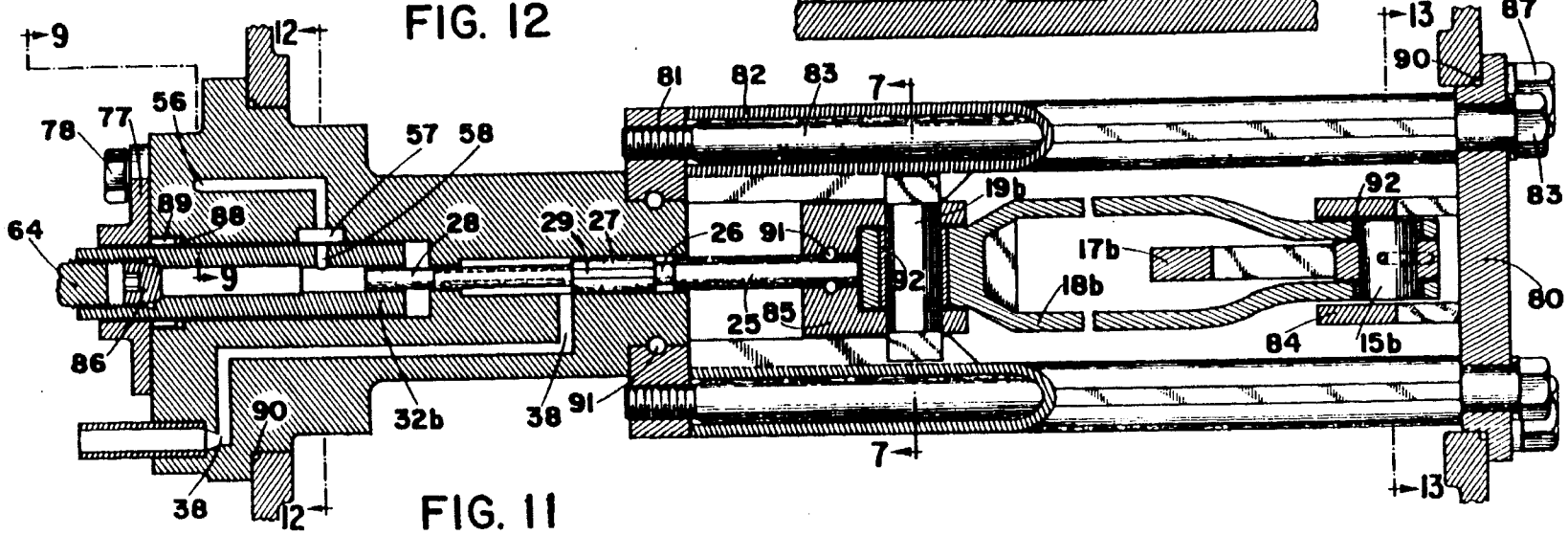

FIG. 11 is a sectional view in perpendicular plane to FIG. 6, along the 11— 11 fractioned line, also shown in FIG. 9 but only for the front part.

Figure 12:
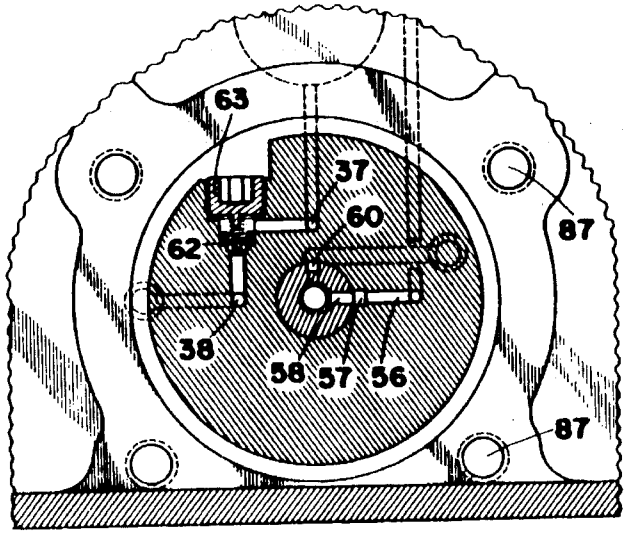

FIG. 12 is a sectional view along the 12— 12 line of FIG. 6 just to show a check-valve.

Figure 13:
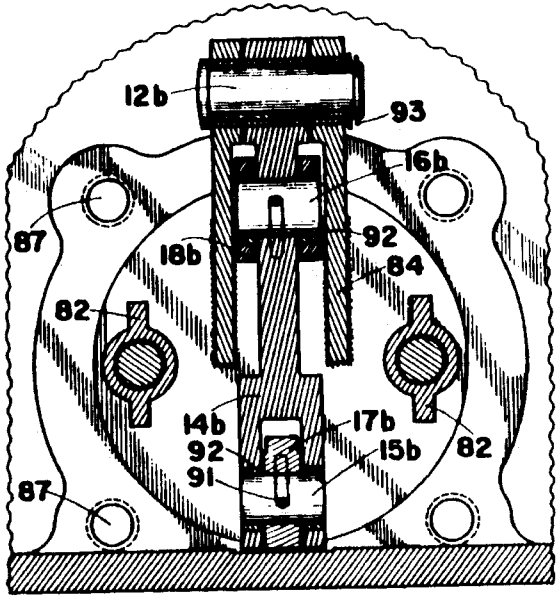

FIG. 13 is a sectional view along the 13— 13 fractioned line as shown in FIG. 6 and 11.

Figure 15:
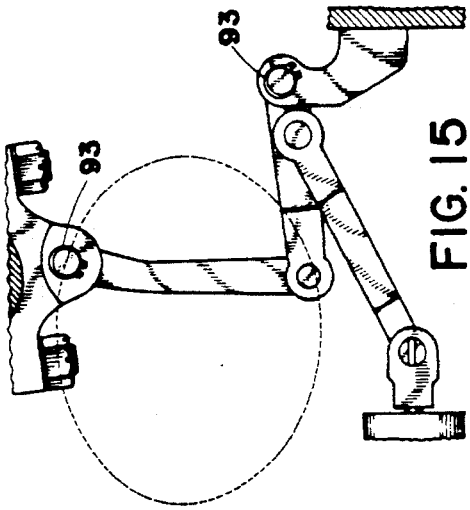
Figure 14:
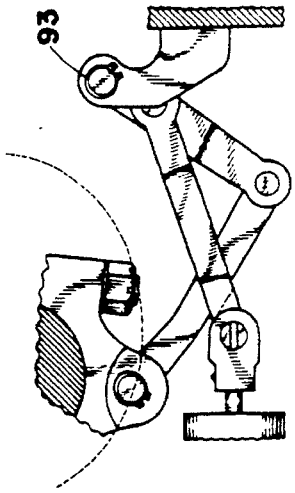

FIG. 14 and 15 in reduced scale show the driving action, the FIG. 14 when two thirds of the injection stroke have been run. FIG. 15 in a position corresponding to other idle point of the pump alternative stroke.

When an internal ignition piston engine operates, the crank shaft 10 located at the center of each rod head, draws a circumference, while the center of an axis 11 which is supported in a centered prolongation of each rod head, draws a figure similar to ellipse 13. Considering as fixed point the axis center 12 attached to the body of pump 21 which allows piece 14, that also holds axles 15 and 16, to rotate, the axle center 15 draws a circumference arc while it is driven by piece 17 which opposite rotating end is in axle 11. Arc shaped piece 18, one of which ends rotates in axle 16, which center also draws a circumference arc when it is driven by piece 14, forces the axle 19, located at the opposite end of piece 18 which is also attached to the pump and which can only be allowed the lineal motion, to an alternative motion.

As it can be observed, this pump can operate at the low section of an engine, attached to the sides of the carter contourn 20. The pump frame 21 has two ducts, one for fuel admission 22 and the other for discharge 23, duct 23 should have the starting end enclosure 24 expanded in the same direction as the pump axis.

The pump piston is composed of four parts, 25, 26, 27 and 28. Part 25 and 27 of even diameter, parts 26 and 28 of shorter diameter, part 27 has a peripheral channel 29 and part 28 an internal channel 30 with two holes towards the periphery at the ends of such channel, one of the holes is at the brink of the fourth part limiting with the third.

The piston displaces within the two cylinders 31 and 32, these cylinders at the same time, slide into the pump frame due to the action of external mechanism 39 and 40.

Cylinder 31 comprises most part of the piston and has, at one end, an inner diameter matching the outside of the piston's fourth part forming in this way the compression chamber for the fuel. It has also two radial holes 37 and 38 which in this case have a lineal matching. Hole 37 corresponds to the discharge, it connects with the enclosure 24 and it should be matching with channel 29 when the piston displaces. This cylinder 31 must have all along a peripheral channel 33, which should contact hole 38 corresponding to the fuel intake.

Cylinder 32 has the inner diameter matching the outside of the piston's part 28, it has also a hole, enough ample and parallel to the axis to give room to the passing of a thin bar 35 for driving the cylinder 31, having also all along a peripheral channel 34.

In a Diesel engine, each center of a crankpin draws a circumference, i.e. 360° and when the driving piston reaches the top of its stroke within the cylinder, we use to say that it is in the "Idle top point"; the fuel injection in these engines is done within a range of 25° before and 15° after the "Idle top point" of above mentioned crankpin, in order to make a comparison I have established paints a and b of the curve 13 when axle 11 displaces from a toward b, which corresponds approximately to the limits of above mentioned range, which I call effective displacement.

When the axle 11 runs all the curve 13, the axle 19 runs a lineal space that I call maximum displacement. The effective mechanism of present invention is subject to the relative position of axle 12 and of the pump piston axis with respect to the crankshaft center rotation 10, and the shape and dimensions of pieces 14, 17 and 18 in such a way that the effective displacement of axle 19 is near to its corresponding maximum displacement; the FIG. 1, 3 and 4 correspond to a design where the effective displacement of axle 19 is approximately 50% from its maximum.

Figures 3, 4:
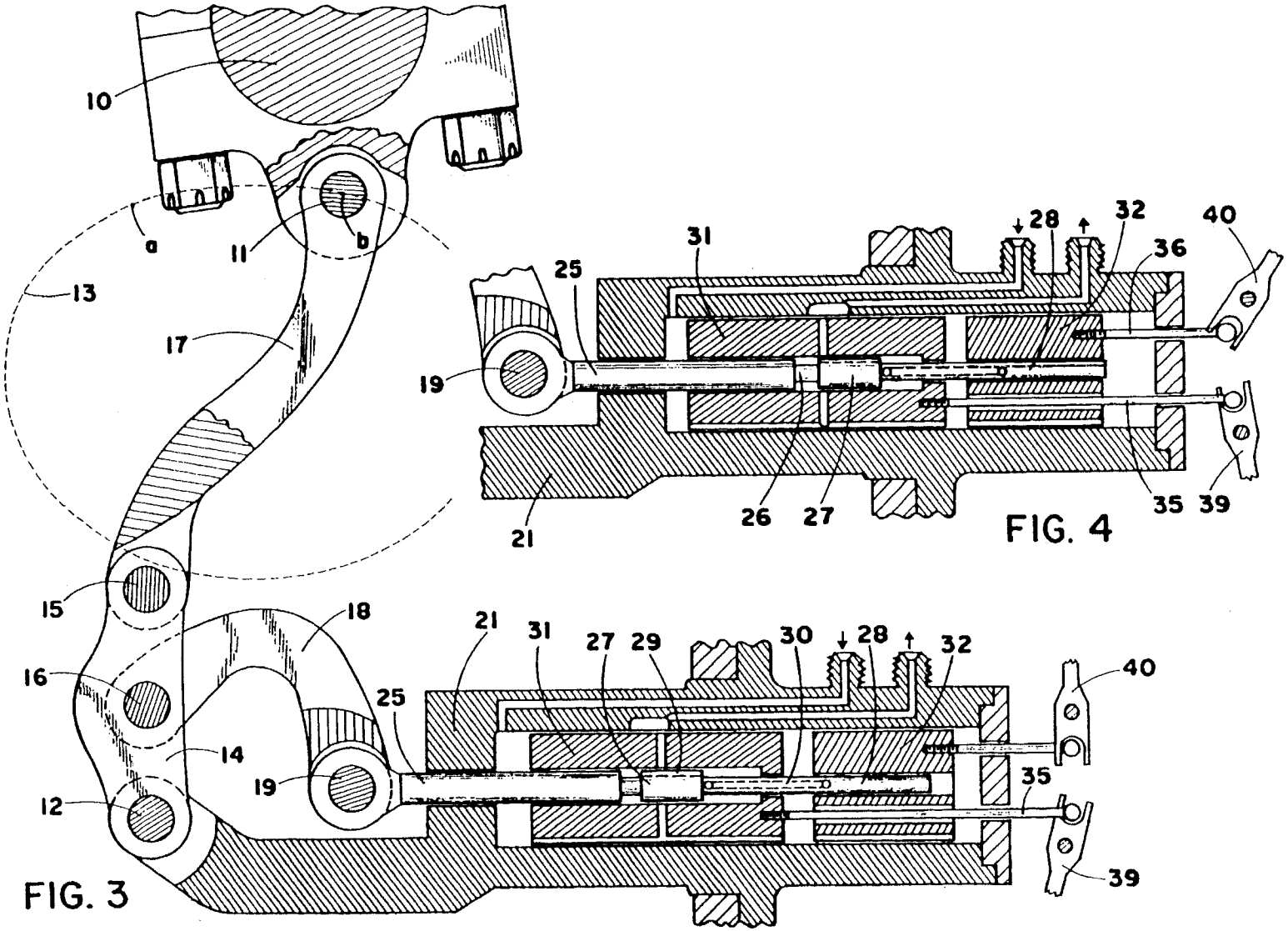
FIG. 3 shows a view similar to FIG. 1 but at the time when the pump piston is in its injection stage.
FIG. 4 shows a view similar to FIG. 3 but only of the pump with different positions of the sliding cylinders.

Operation of the pump is as follows: fuel arrives by means of channel 22 and passes through the annular space comprised between the body 21 and the cylinder 31 to arrive to channel 33, and through hole 38 arrives to the compression chamber, when the piston displaces its part 27 closes hole 38, then the fuel enclosed into the compression chamber is allowed to go out, or through hole 37 or through channel 30, through the farthest hole in part 27 until this last hole is closed by cylinder 32, as it is shown in FIG. 3. Afterward the only free way for the fuel to go out is hole 37, in order to pass through enclosure 24 to channel 23, and from there to the injector. Since displacement of the piston continues, there is a time when part 27 finishes the closing of hole 38, and holes 37 and 38 are connected through the annular space left by part 26 of the piston, giving in this way an end to the pressure in the compression chamber.

A little portion of fuel confined by the compression chamber escapes through channel 30, this portion should be lesser respectively to how near is cylinder 32 to cylinder 31, such as it can be seen when comparing FIG. 4 to FIG. 3, in consequence, if the engine accelerator governs lever 40, which by means of small bar 36 can displace cylinder 32 in one or other direction, it could be possible to control the amount of fuel supplied to the engine.

In FIG. 3 the axle center 11 matches point b of curve 13 and part 27 of the piston will keep pressure within the chamber for a span of displacement of axle 11 after point b, but if we wish the pressure to finish in point b, the cylinder 31 would have to be displaced toward the inner section of the engine, as it is shown in FIG. 4 where part 27 of the piston is going to complete coverage of hole 38. This means that displacement of cylinder 31, in one or other direction, will advance or delay the time to start or to complete the pressure within the compression chamber respectively to the position of axle center 11 in curve 13, in consequence, if appliance of the engine which advances or delays the fuel injection can govern lever 39, which by means of small bar 35 can displace cylinder 31 in one or other direction, it should be possible to control the instant of fuel injection with respect to the "Idle top point".

Above description corresponds to the fuel injection in Diesel engines, but it is also applicable to gasoline engines, such as it is shown in the mechanism of FIG. 5 through 15, for direct gasoline injection into the driving cylinder, when axle 11 is found between the points c and d of curve 13 i.e., within the range corresponding to "Lower idle point"; to obtain the air and gasoline mixture before the compression stroke of the driving piston.

Figure 5:
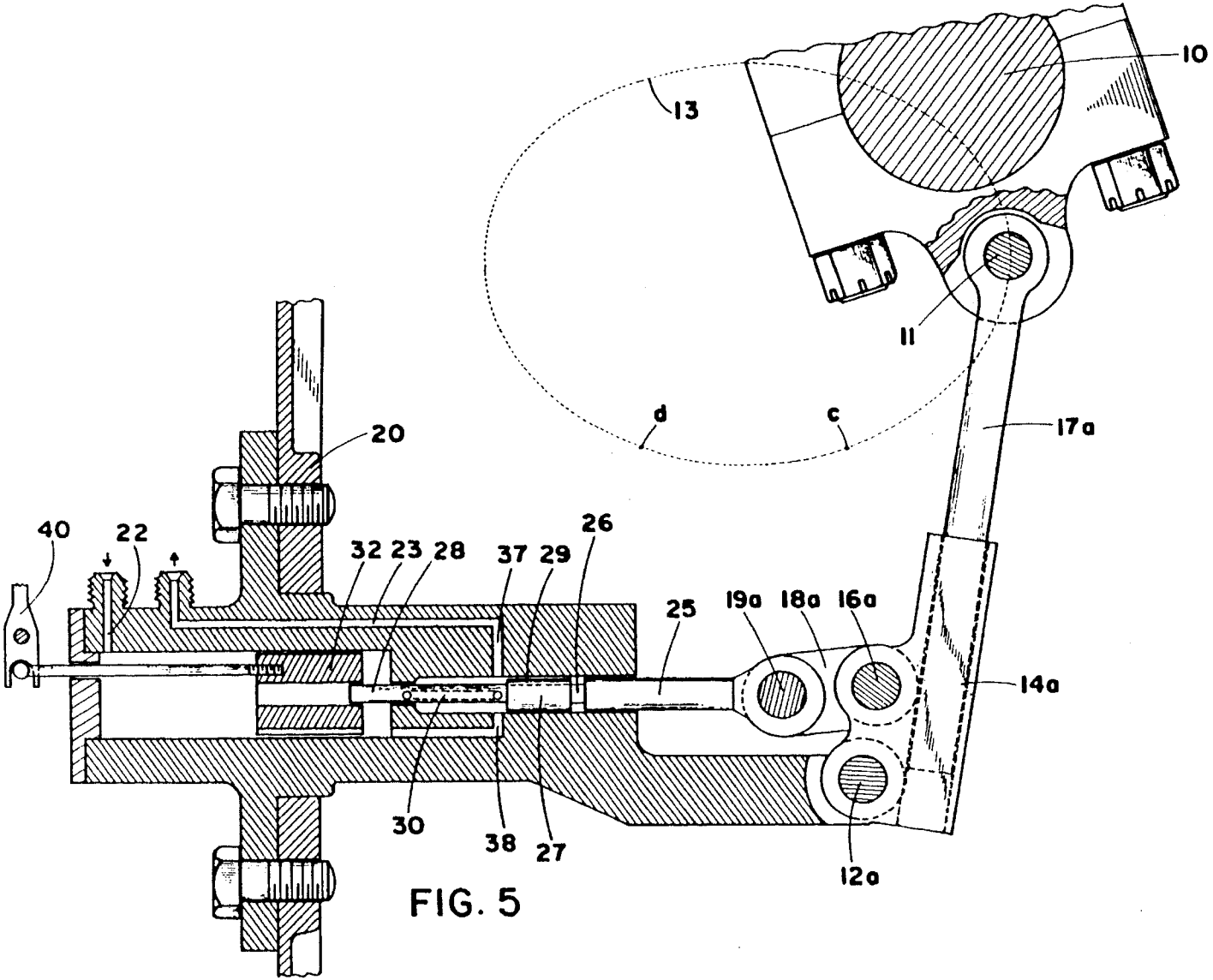
FIG. 5 shows a cross cut section of other type of pump, which uses the same principle or driving action but with a variation of the driving accessories, in this case the first cylinder is not used.

FIG. 5 shows as fixed point the center of axle **12*a* corresponding to body 21*a* where the piece 14*a* can rotate as being driven by the sliding rod 17*a*. The piece 14*a* holds the axle 16*a* which moves the piece 18*a*, and this, at the same time, moves axle 19*a* of the pump piston. In this case, there is only one displacing cylinder to control the portion of fuel feeding the engine FIG. 6 up to 15 correspond to a more improved pump type for the use of gasoline, and knowing that this fuel has not lubricating properties, two circuits are considered in this design, one of them for oil directly driven by the pump according to above paragraphs, and the other as a fuel circuit, both circuits interactivated by means of an impermeable membrane and with limited strain 41 enclosed within an hermetic chamber in such a way that the variations of oil pressure due to operation of the pump, are transferred to the fuel through the strain effect of such membrane, same that is supported at the side of the oil circuit on a flat surface with perforations 42, against which it is pressed at the side of the fuel by a disk 43 pushed by a spring 44, such disk attached to a cylinder 45** to be centered with respect to the spring.

At the side of the fuel circuit there are two retention valves 46 and 48, suitable for this use which design is already known in the market, with their respective suction pipes 47 and exhaust 49, these valves are attached to a disk shaped piece 50 which at the same time holds the membrane 41 against the piece **21*b* by means of bolts 51**.

At the side of the oil circuit, the discharge through hole and duct 37, reaches the membrane chamber 41 at the lower part passing to the upper part of said chamber, where there is placed a check-valve 52, and a draining valve 53. The purpose of the draining valve is to remove the air in this circuit before starting the normal pump operation, for which reason the spring 54 and the plug 55 are together.

After passing through the check-valve 52, the oil follows its course by duct 56 (see FIG. 9) and reaches the channel 57 (see FIG. 11), from there to hole 58 of piece **32*b*, passing thus to the hole 59 of this same piece which at the same time connects to longitudinal channel 60 in the periphery of 32*b*. Channel 60 at the same time connects to duct 61 of piece 21*b*** through which the oil comes back to its corresponding deposit.

The purpose of the oil running according to description of above paragraph is to allow a constant circulation of the oil that puts into operation the membrane 41. In fact, the oil which is forced to pass through hole and duct 37 until reaching to duct 61, could not push the said membrane forced by the hard spring 44 but, only after the part 28 of the pump during its displacing stroke covers the hole 58 in full, it is then that the oil that has been subject to pressure by the pump, if a free duct is not found, will exercise pressure against the membrane, and this membrane as well against the fuel, until part 27 of the pump finds the hole and duct 38 such as it was previously described, when holes and ducts 37 and 38 are intercommunicated, the pressure against membrane 41 stops.

On return of the pump piston, the oil will have a negative pressure or emptyness, to avoid this, check-valve 62 as shown in FIG. 12 is included, this valve, when it is aligned with draining plug 63 and a little spring, has the purpose of intercommunicating the duct 38 for oil arrival from its respective deposit, to duct 37, when the pressure is negative in this last duct.

There are also the following supplementary accessories that are shown in the mentioned system starting from FIG.6: both end threaded rod 64 for driving of the cylinder **32*b*, a cube shaped piece 65 matching rod 64, inside of which the rod that bears a peripheric channel can rotate but cannot axially displace because the special screws 66 that have an end guide, are threaded to the cube and match with the guide in the peripheric channel of the rod, the cube has at both sides, centered and perpendicular to the FIG. 6 plane, small axles to fit the rings of the eyebolt shaped pieces 67, the ends or shanks of such eyebolts perform a sliding matching to bar 68, which purpose is to simultaneously activate all cylinders 32*b* who govern the displacing volume of the pumps that correspond to an engine, the bar 68 is also matching in sliding way to cylinder 69, this with suitable holders 70 centering guides 71 and bolts 72 is attached to the carter of the engine. In FIG. 10 the rod 73 is shown to be used in handling the control, with an auxiliary holder 74 attached to the cylinder 69, also a recovery spring and a bolt to be used as an adjustable regulator for minimum injection to the pumps. Each cylinder piece 32*b* has a channel parallel to the axis where a "T" shaped guide 75 matches, held by means of screw 76 to piece 77 and this at the same time is held by bolts 78 to the piece 21*b*. The purpose of the guide 75 is to hinder the rotation of piece 32*b*** allowing only the axial displacing.

Each piece 64 carries also at the outside a channel acting as a screw head, with which, after loosing the nut 79 it could be possible to put into or to pull out said piece 64 from body **32*b***, with the purpose of doing, if it should be necessary, the individual adjustment of each of the pumps.

As a matter of fact, all these systems have to operate supported rigidly within the carter of the respective engine. It has been taken into account, in the design corresponding to FIG. 6 and following ones, such system that it will be possible to offer accurate rigidity and easy assembly. Due to its construction the pump is rigid, for which reason it is shown in the design as directly supported by four bolts 87 at a side of the carter, but to get more accuracy as a set with its corresponding driving system it has been shown in the design as mounted between both sides of the engine carter, using the shores 82 which are tightened by tensors 83 that are long bolt shaped, these latter accessories act at one end against the elliptic flange shaped accessory 81, anchored with conical pins to the pump frame and at the other end against the rigid cover 80 held with four bolts 87 at the other side of the carter.

Figures 1, 2:
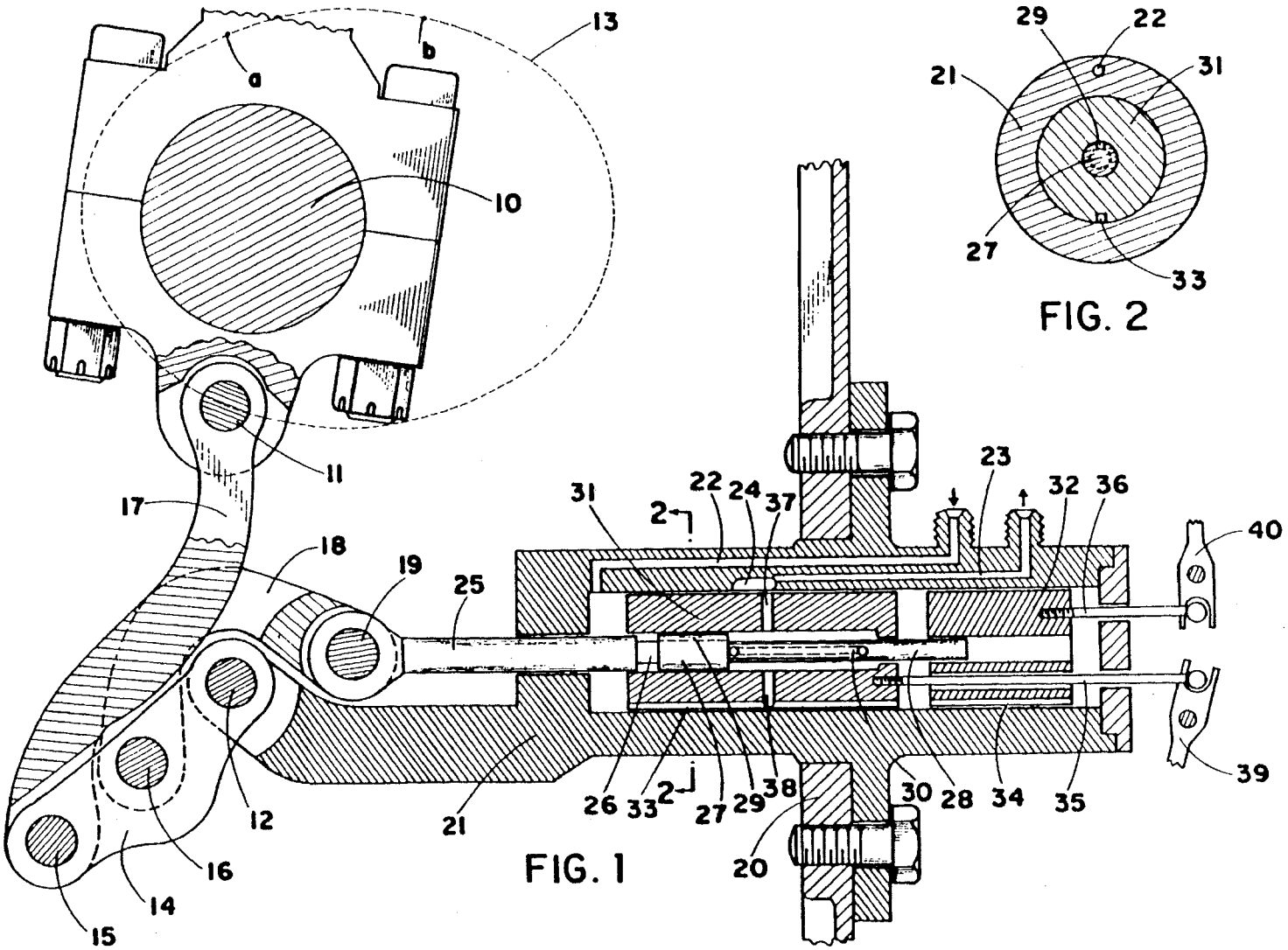
FIG. 1 shows a cross section symmetry view throughout the pump, the position of the piston before the driving action and the corresponding location of the rod head.
FIG. 2 shows a radial cross section view of the pump.

The symmetric pieces 84 welded to the cover 80 bear the axle **12*b* which at the same time is the rotating center of piece 14*b*, which is holding the axles 15*b* and 16*b*, all the rest keep likeness with description made for FIG. 1, the most remarkable difference is, as already mentioned for FIG. 5**, this system corresponds to a fuel injection pump directly to the driven cylinder of an engine before the starting of the compression stroke.

With regards to the accessories appearing in the mentioned pump starting from FIG. 6, the shores 82 of the cylinder with all along enforcements such as it appears in FIG. 13, they bear at the end attached to the pump frame the channels that appear in FIG. 7, the flat guides that has at each end the axle **19*b* will slide in such channels, with the inclusion of these guides and channels the fatigue that the slanted displacement of accessory 18*b* may produce against the pump axis that should be only displaced in the horizontal direction, will be avoided. This part of the design is completed with the supporting piece 85 that holds axle 19*b* and, with conical pins,to the part 25 of the pump piston. There are other accessories which are the following: plug 86 to hinder the leak of oil through lower part of piece 32*b*, rubber ring 88 pressed by metal ring 89 to hinder the leak of oil through the outside of piece 32*b*, rubber ring 90 also to hinder the leak of oil through the rims of pieces 21*b* and 80; 91 in general all the conical pins that appear in the design; 92 in general all the bearings that are shown for the sliding of axles; 93 in general all clamp ring on shaft; 94** tray for the carter oil.

Of course this invention is applicable to engines with cycle of two strokes and it is also applicable to those of four stroke cycle, it should be necessary to use in such cases, one fuel individual pump every two driving cylinders, that way, it could be possible to have, in the pipeline that discharges the fuel through two branches toward the respective injectors, line valves in each one of these branches; these valves could be driven by the rotatory camshaft, which in these engines, rotates at half the speed of the crankshaft, this way, if such a mechanism is used, then the cam that drives the admission valve of the driving cylinder where the fuel injection corresponds, at the same time is opportunely driving the above mentioned line valve, then, it should be possible to apply this invention to the four stroke cycle engines.

I claim:

1. Fuel injection pump for internal combustion engines, by means of pistons, each piston formed by four consecutive cylindric parts with a common axis, the first and third parts have an even diameter, the second and the fourth have a diameter that is shorter than the first and third parts, said third part has one or more periphery channels along its entire length, the fourth part has an internal channel parallel to the axis which connects to the periphery by means of holes placed at both ends of said internal channel, one of these holes is located at the brink of the fourth part on the limit with the third part, every piston is axially sliding within two consecutive cylinders which, at the same time, are independently and axially sliding within the pump body, the first of the mentioned cylindric bodies, corresponding to any of the pistons, comprises from the first up to the fourth part of its respective piston matching exactly the diameter of the first and third parts of said piston, with the exception of a small span in the internal end which also matches precisely to the diameter of the fourth part forming in this way an enclosure of variable volume every time that the corresponding piston displaces internally, said first cylinder has a hole in such a radial direction that the outside is communicated with a channel of the pump body channel that is feeding the fuel to the pump, and the inside end of such hole of radial direction has a sliding contact with the peripherial cylindric surface of the third part of the piston, without reaching the communication with any of the periphery channels of such third part of the piston, the discharge of the pump toward the respective injector is carried out through the channels which have communication with the mentioned enclosure of variable volume, the second cylinder corresponding to any one of the pistons matches precisely the mentioned fourth part of the respective piston.

2. Fuel injection pump for internal combustion engine, by means of pistons, each piston formed by four consecutive cylindric parts with a common axis, the first and third parts have an even diameter, the second and the fourth have a diameter that is shorter than the first and third parts, said third part has one or more periphery channels along its entire length, the fourth part has an internal channel parallel to the axis which connects to the periphery by means of holes placed at both ends of said internal channel, one of these holes is located at the brink of the fourth part on the limit with the third part, every piston is axially sliding within the pump body with the exception of one span of the fourth part which slides within a sliding cylinder axially sliding at the same time within the pump body, each piston matching exactly the diameter of the first and third parts and one span of the fourth part, forming in this way an enclosure of variable volume every time that the corresponding piston displaces internally, to such enclosure within the pump body arrives a channel that is feeding the fuel to the pump, such feeding channel has a sliding contact with the peripherial cylindric surface of the third part of the piston, without reaching the communication with any of the periphery channels of such third part of the piston, the discharge of the pump toward the respective injector is carried out through the channels which have communication with the mentioned enclosure of variable volume.

3. Fuel injection pump for internal combustion engines in accordance to claim 1, in which the alternative lineal motion of each of the pistons of the pump corresponding to each of the driving cylinders of the engine, is obtained transforming, with the use of auxiliary pieces, the translating motion of an auxiliary axle located in the head of every of the corresponding driving rods, when said driving rods are driven by the respective engine.

4. Fuel injection pump for internal combustion engines in accordance to claim 2, in which the alternative lineal motion of each of the pistons of the pump corresponding to each of the driving cylinders of the engine, is obtained transforming, with the use of auxiliary pieces, the translating motion of an auxiliary axle located in the head of every of the corresponding driving rods, when said driving rods are driven by the respective engine.

5. Fuel injection pump for internal combustion engines in accordance to claim 1, with the variation that each piston does not work directly with fuel but with an oil which flows in both directions according to the piston displacement, producing variations of pressure in an elastic, nearly flat membrane into a hermetic enclosure which said membrane divides into two partial enclosures, one of these enclosures formed by such division remains full with the oil and the other full with fuel, at the start of every cycle of displacement of the respective piston, the membrane, having a moderate degree of deformation is compelled by a plate and spring to lean against a rigid piece which has multiples holes, through these holes the membrane cannot pass but the oil does, the mentioned oil enclosure has a drain system through a check valve toward a serial duct assembly passing through a duct located in radial direction in the second cylindric body that slides over the fourth part of the corresponding piston described in the mentioned claim, said fourth part of the piston upon displacement interrupts the mentioned draining, allowing with the continuation of the piston displacement the increase of the pressure of the oil, that pressure is transferred to the fuel by the membrane.

6. Fuel injection pump for internal combustion engines in accordance to claim 2, with the variation that each piston does not work directly with fuel but with an oil which flows in both directions according to the piston displacement, producing variations of pressure in an elastic, nearly flat membrane into a hermetic enclosure which said membrane divides into two partial enclosures, one of these enclosures formed by such division remains full with the oil and the other full with fuel, at the start of every cycle of displacement of the respective piston, the membrane, having a moderate degree of deformation is compelled by a plate and a spring to lean against a rigid piece which has multiple holes, through these holes the membrane cannot pass but the special oil does, the mentioned oil enclosure has a drain system through a check valve toward a serial duct assembly passing through a duct located in radial direction in the cylindric body that slides over the fourth part of the corresponding piston described in the mentioned claim, said fourth part of the piston upon displacement interrupts the mentioned draining, allowing with the continuation of the piston displacement the increase of the pressure of the oil, that pressure is transferred to the fuel by the membrane.

7. Fuel injection pump for internal combustion engines in accordance to claim 1, with the variation that each piston does not work directly with fuel but with an oil which flows in both directions according to the piston displacement, producing variations of pressure in an elastic, nearly flat membrane into a hermetic enclosure which said membrane divides into two partial enclosures, one of these enclosures formed by such division remains full with the oil and the other full with fuel, at the start of every cycle of displacement of the respective piston, the membrane, having a moderate degree of deformation is compelled by a plate and a spring to lean against a rigid piece which has multiple holes, through these holes the membrane cannot pass but the oil does, the mentioned oil enclosure has a drain system through a check valve toward a serial duct assembly passing through a duct located in radial direction in the second cylindric body that slides over the fourth part of the corresponding piston described in the mentioned claim, said fourth part of the piston upon displacement interrupts the mentioned draining, allowing with the continuation of the piston displacement the increase of the pressure of the oil, that pressure is transferred to the fuel by the membrane, it is included a by-pass pipe line with check valve between the duct of arrival of oil to the pump and the duct for outgoing of said oil from the pump.

8. Fuel injection pump for internal combustion engines in accordance to claim 2, with the variation that each piston does not work directly with fuel but with an oil which flows in both direction according to the piston displacement, producing variations of pressure in an elastic, nearly flat membrane into a hermetic enclosure which said membrane divides into two partial enclosures, one of these enclosures formed by such division remains full with the oil and the other full with fuel, at the start of every cycle of displacement of the respective piston, the membrane, having a moderate degree of deformation is compelled by a plate and a spring to lean against a rigid piece which has multiple holes, through these holes the membrane cannot pass but the oil does, the mentioned oil enclosure has a drain system through a check valve toward a serial duct assembly passing through a duct located in radial direction in the cylindric body that slides over the fourth part of the corresponding piston described in the mentioned claim, said fourth part of the piston upon displacement interrupts the mentioned draining, allowing with the continuation of the piston displacement the increase of the pressure of the oil, that pressure is transferred to the fuel by the membrane, it is included a by-pass pipeline with check valve between the duct arrival of oil to the pump and the duct for outgoing of said oil from the pump.

* * * * *